US006485352B1

(12) United States Patent
Batcha et al.

(10) Patent No.: US 6,485,352 B1
(45) Date of Patent: Nov. 26, 2002

(54) BRASSIERE

(75) Inventors: Deborah Batcha, New York, NY (US); Gloria Falla, Demarest, NJ (US)

(73) Assignee: Playtex Apparel, Inc., Stamford, CT (US)

( * ) Notice: Subject to any disclaimer, the term of this patent is extended or adjusted under 35 U.S.C. 154(b) by 0 days.

(21) Appl. No.: 09/852,076

(22) Filed: May 9, 2001

Related U.S. Application Data

(60) Provisional application No. 60/203,034, filed on May 9, 2000.

(51) Int. Cl.[7] ..... A41C 3/00
(52) U.S. Cl. ..... 450/41; 450/65
(58) Field of Search ..... 450/41, 45–48, 450/51, 52, 65, 67, 74, 75, 76; 2/78.1, 255, 260, 259, 264

(56) References Cited

U.S. PATENT DOCUMENTS

| | | | | | |
|---|---|---|---|---|---|
| 2,632,167 | A | * | 3/1953 | Robbins | 450/65 |
| 2,761,147 | A | | 9/1956 | Glickin | |
| 2,794,984 | A | | 6/1957 | Astor | |
| 2,967,527 | A | | 1/1961 | Maas | |
| 2,973,764 | A | | 3/1961 | Steiner | |
| 3,094,991 | A | * | 6/1963 | Smith | 450/74 |
| 3,433,229 | A | * | 3/1969 | Tuschman | 450/67 |
| 3,566,878 | A | * | 3/1971 | Radomski | 450/74 |
| 3,704,713 | A | | 12/1972 | Hopper | |
| 3,746,008 | A | * | 7/1973 | Locascio et al. | 450/74 |
| 3,964,491 | A | * | 6/1976 | Martini | 450/67 |
| 4,372,322 | A | | 2/1983 | Stern et al. | |
| 4,444,192 | A | | 4/1984 | Stern et al. | |
| 5,045,019 | A | * | 9/1991 | Capasso | 450/74 |
| 5,215,494 | A | | 6/1993 | Flanagan | |

FOREIGN PATENT DOCUMENTS

| | | |
|---|---|---|
| DE | 29810765 U1 | 12/1999 |
| DE | 29909775 U1 | 11/2000 |

* cited by examiner

*Primary Examiner*—Gloria M. Hale
(74) *Attorney, Agent, or Firm*—Ohlandt, Greeley, Ruggiero & Perle, LLP

(57) ABSTRACT

There is provided a brassiere that includes a body having a pair of breast cups, a pair of stretchable panels each adjacent a separate breast cup and connected to a back of the brassiere, and a pair of stretchable sheaths secured along a lower portion of the breast cup and floating along the panel of the brassiere. Each panel is made of a stretchable material. The brassiere further includes a pair of underwires each positionable in one sheath. Preferably, the underwire is anatomically shaped so that the curve of the underwire is greater on the inner portion compared to the outer portion.

24 Claims, 4 Drawing Sheets

BRASSIERE

This application claim the benefit of provisional application Ser. No. 60/203,034, filed May. 9, 2000.

BACKGROUND OF THE INVENTION

1. Field of the Invention

The present invention relates to brassieres. More particularly, the present invention relates to a brassiere having underwire support, yet permits natural shaping and flexibility.

2. Description of the Prior Art

To be comfortable, a brassiere must combine both support for the wearer's breasts and freedom of movement for the wearer's body.

In order to give freedom of movement to the wearer, some brassieres include a high percentage of stretchable materials, such as elastic. However, brassieres formed primarily of stretchable fabric may not provide sufficient breast support.

To achieve a suitable level of support for the breast, brassieres use support underwires and/or nonstretchable fabric in certain areas. However, support underwires, especially when secured in place by nonstretchable material, can become an impediment to an active wearer. Moreover, support underwires, especially during movement by an active wearer, may poke through the fabric of the brassiere.

There are brassieres that attempt to combine support and freedom of movement. For example, some brassieres place the underwires in an inner panel next to the skin, so that the underwires are spaced apart from the material forming the breast cups. However, this configuration increases the complexity of the brassiere, and may do little to overcome the dual problem of achieving flexibility and support.

Giving the foregoing, there is a need for a brassiere that provides freedom of movement without discomfort, as well as support for the breasts, during all activities of the wearer.

SUMMARY OF THE INVENTION

It is an object of the present invention to provide a brassiere that provides freedom of movement without affecting adversely the brassiere's ability to support the wearer's breast.

It is also an object of the present invention to provide such a brassiere that has a partially floating underwire.

It is another object of the present invention to provide such a brassiere that has stretchable panels.

It is yet another object of the present invention to provide such a brassiere that has a stretchable underwire sheath.

It is a further object of the present invention to provide such a brassiere that has underwires with an anatomically desired shape thereby enhancing support, natural shaping and comfort on the body.

These and other objects of the present invention are achieved by a brassiere that includes a body having a pair of breast cups, a pair of panels each adjacent to a separate breast cup and connected to a back of the brassiere, and a pair of stretchable sheaths secured along a lower portion of the breast cup and floating along the side panel of the brassiere. Each side panel is made of a stretchable material. The brassiere further includes a pair of underwires, each positionable in one of said pair of sheaths. In a preferred embodiment, the panels stretch only in the sideways or horizontal direction. Since the sheath is not attached to the body of the brassiere along the side panel, it floats thereby providing greater flexibility. In a first embodiment, the panel one panel that extends to the back of the brassiere. In a second embodiment, the panel is a side panel that is connected to one or more other panels, one of which extends to the back of the brassiere. Preferably, in any embodiment, the underwire is anatomically shaped so that the curve of the underwire is greater on the inner portion compared to the outer portion thus providing enhanced support at all times.

DETAILED DESCRIPTION OF THE INVENTION

Figure 1:
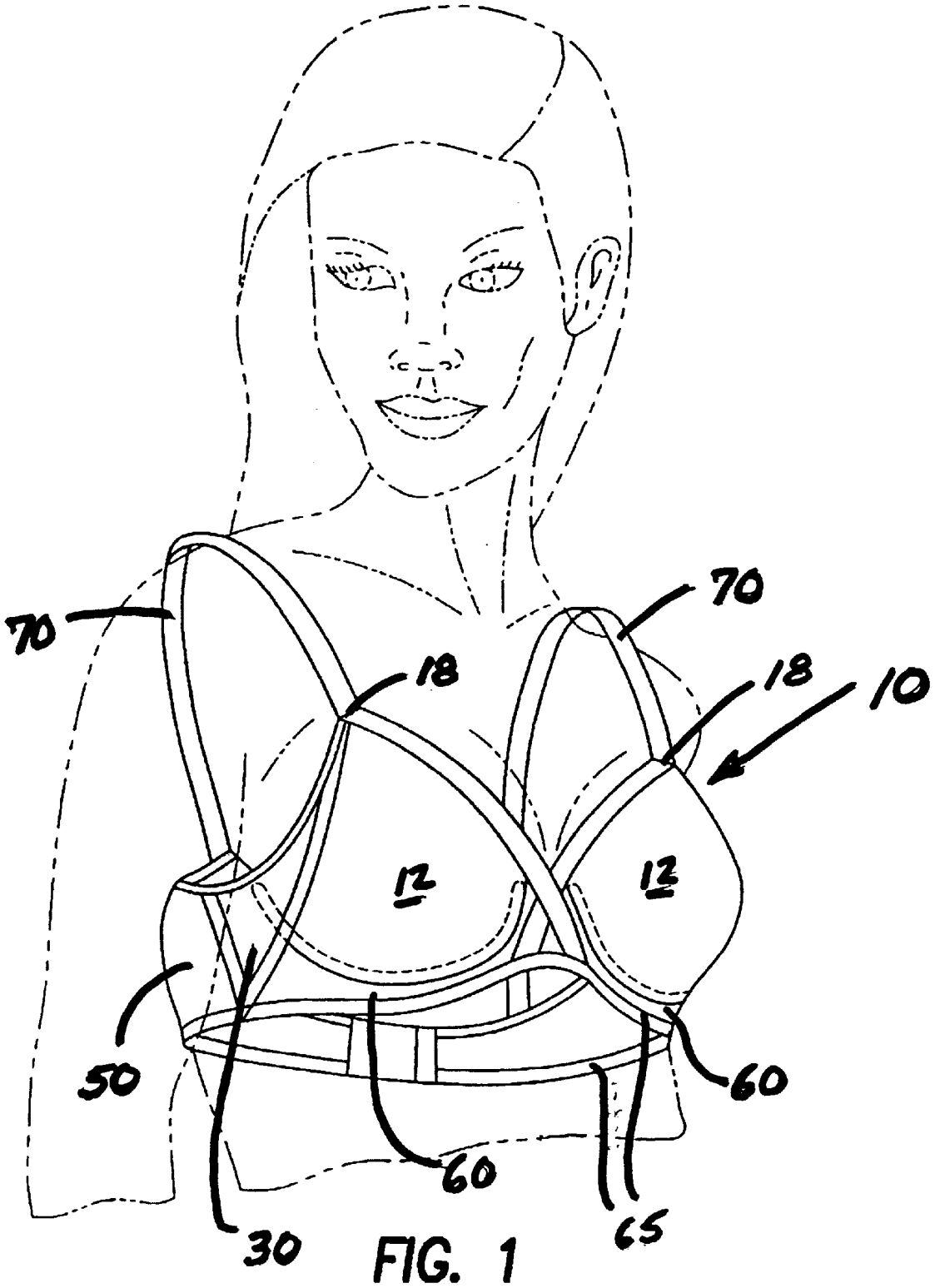
FIG. 1 illustrates a brassiere according to the present invention.

Referring to the drawings and, in particular, FIG. 1, there is provided a brassiere according to the present invention, generally represented by reference numeral 10. Brassiere 10 has a body with a pair of breast cups 12, a pair of side panels 30 connected to the pair of breast cups, and a pair of back straps or panels 50 connected to the pair of side panels, and a pair of support panels 60 connected to the pair of breast cups 12 and a body encircling band 65.

Figure 2:
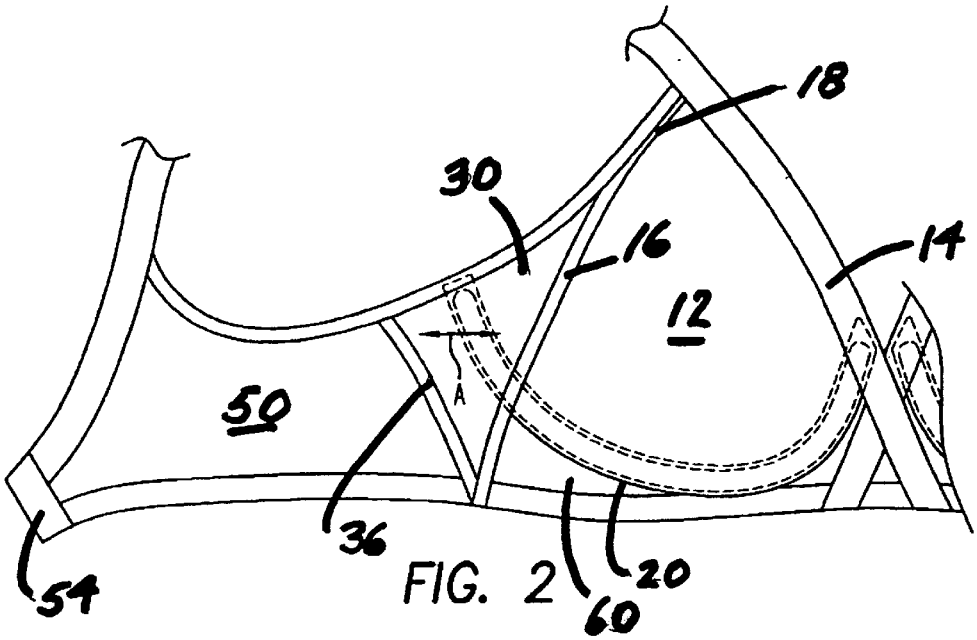
FIG. 2 is a portion of the exterior of the brassiere of FIG. 1.
Figure 3:
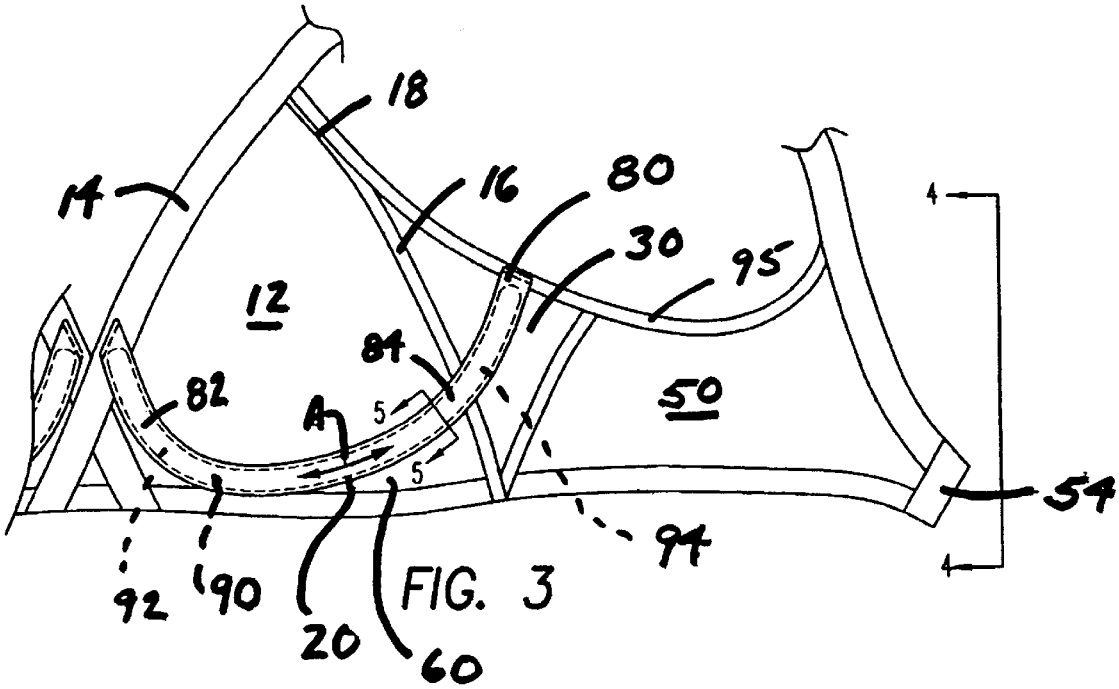
FIG. 3 is a portion of the interior of the brassiere of FIG. 1.

As shown in FIGS. 2 and 3, each breast cup 12 has an inner edge 14, an outer or back edge 16, an upper edge 18 and a bottom edge 20. Each outer edge 16 is connected to one side panel 30. In addition, the bottom edge 20 of each breast cup 12 is connected to a support panel 60.

Each side panel 30 at an outer or back edge 36 thereof is preferably connected to one back panel 50. The back panels 50 encircle the remainder of the torso of the wearer and are joined together by conventional fasteners 54, such as, for example, hook-and-eye closures.

In an alternative embodiment of the present invention, brassiere 10 may encircle the torso of the wearer and breast cups 12 may be joined together by a front closure utilizing conventional fasteners.

As illustrated in FIG. 1, brassiere 10 preferably has a pair of adjustable shoulder straps 70 that connect to upper edges 18 of breast cups 12 and back panels 50.

As used herein the terms "sideways," "vertical," and "horizontal" are defined in reference to the orientation of brassiere 10 as it would be positioned on a wearer's body and, thus, shown in FIG. 1. Thus, back panels 50 extend substantially sideways or horizontally, while shoulder straps 70 extend substantially vertically.

Again referring to FIGS. 2 and 3, side panel 30 is a panel, preferably having a triangular shape, disposed between breast cup 12 and back panel 50. Side panel 30 is made of a stretchable or elastic type material. Side panel 30 may be made of any suitably stretchable material that is adapted to stretch primarily, and preferably only, in the sideways or horizontal direction. Thus, each side panel 30 provides one-way stretch. Accordingly, side panel 30 is substantially inflexible in the vertical direction. Preferably, side panel 30 is made of a stretch woven or elastomeric fabric.

FIG. 3 illustrates the inside of brassiere 10. Underlying breast cup 12 and side panel 30 is sheath or wire channeling 80. Sheath or wire channeling 80 is adapted to receive underwire 90. Sheath or wire channeling 80 has a first portion 82 that is positioned along the lower portion of breast cup 12 and a second portion 84 that is positioned angularly in breast cup 12 and side panel 30. Sheath or wire channeling 80, namely first portion 82 and second portion 84 is adapted to accommodate underwire 90. First portion 82 is connected to breast cup 12. Preferably, first portion 82 is connected just up to outer edge 16. Alternatively, but less preferably, first portion 82 may be connected to an inner lining (not shown) that is separated from breast cup 12 or partially integrated with the breast cup.

Figure 6:
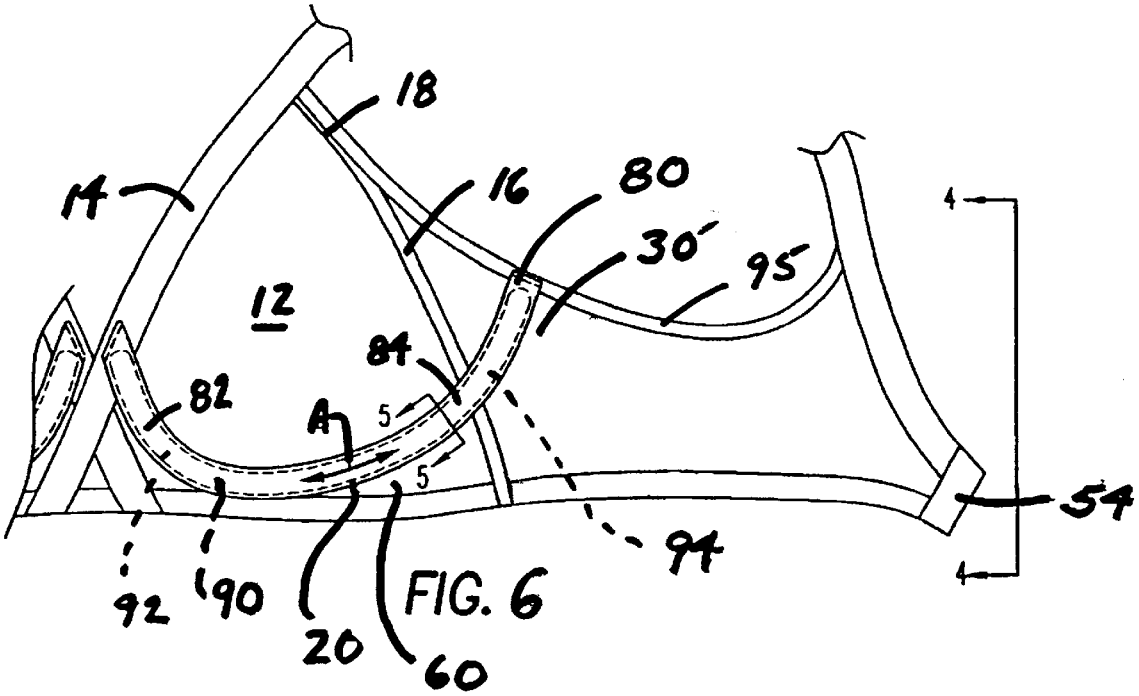
FIG. 6 is an alternative embodiment of a portion of the interior of the brassiere of FIG. 1.

In an alternative embodiment of the invention, shown in FIG. 6, side panel 30 and back panel 50 of FIG. 1, are made as one integral panel 30'. Panel 30' is made from one piece of stretchable or elastic type material. The function of panel 30' remains the same as side panel 30 of FIG. 1 in that it provides one-way, horizontal stretch at the area of each breast cup 12.

Figure 4:
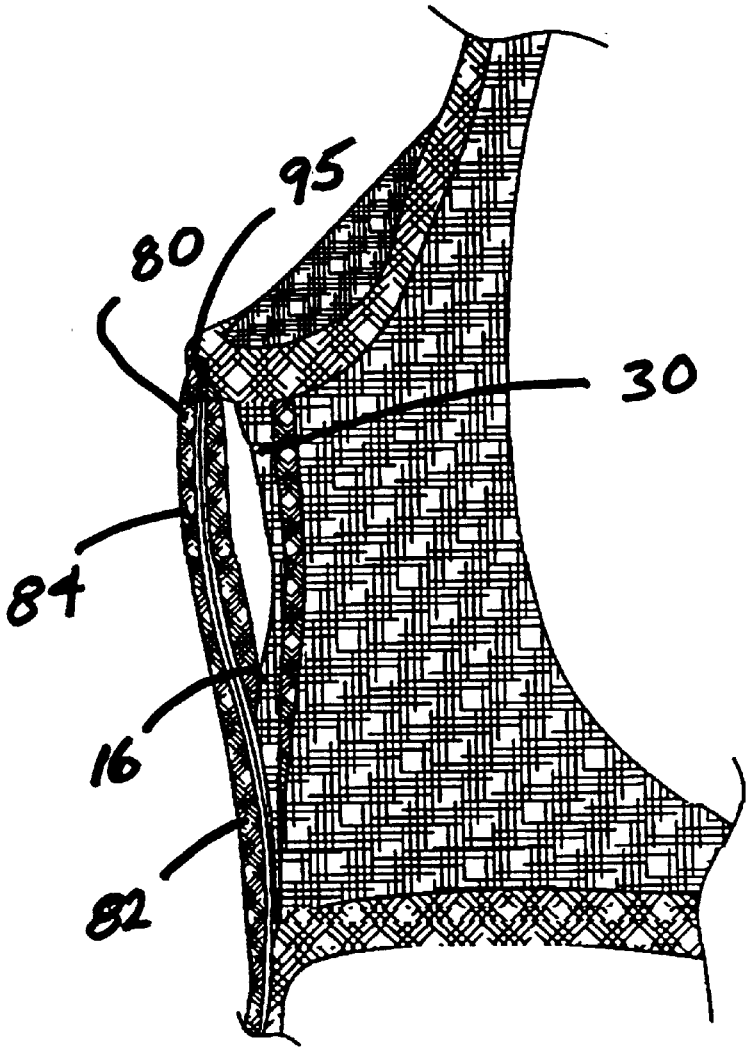
FIG. 4 is a cross-sectional view taken along line 4—4 of FIG. 3.

Referring to FIG. 4, second portion 84 of sheath or wire channeling 80 is not attached to side panel 30 (or panel 30' of the embodiment shown in FIG. 6). Instead, the distal end of second portion 84 is connected to underarm edge 95. Thus, second portion 84 "floats" along side panel 30 between underarm edge 95 to the side of outer edge 16 in breast cup 12, while first portion 82 is secured to support panel 60 or breast cup 12.

Figure 5:
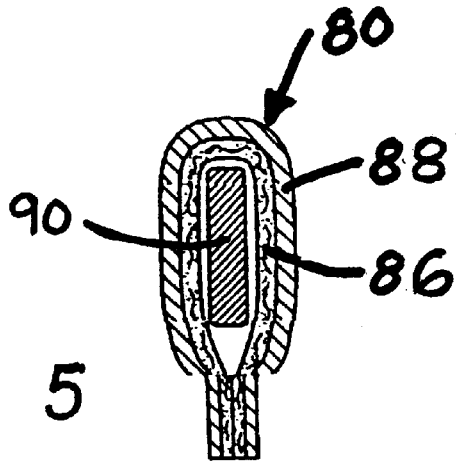
FIG. 5 is a cross-sectional view taken along line 5—5 of FIG. 3.

Sheath or wire channeling 80 is made of a stretchable material. Accordingly, sheath or wire channeling 80 stretches as shown by arrows A seen in FIGS. 3 and 6. As shown in FIG. 5, sheath or wire channeling 80 is preferably made of two plies. Such a two ply structure has been found to avoid underwire poke through and to provide more comfort to the wearer. The inner ply is a biased cut cushioning fabric layer 86. The outer ply is a covering fabric layer 88.

Cushioning fabric layer 86 may be made of cotton batting, polyester non-woven, or other suitable padding material. Preferably, cushioning fabric layer 86 is a one hundred percent polyester non-woven material. A preferred one hundred percent polyester non-woven material is manufactured by Tietex Corporation U.S.A. and sold under the tradename T316. Covering fabric layer 88 is wrapped over cushioning fabric layer 86. Covering fabric layer 88 is preferably made of stretchable material, such as elastomeric, or stretch woven, material that is the same as side panel 30.

In one embodiment, side panel 30 or panel 30' is made of a three bar knit. The elastomeric, or stretch woven, fabric may be made of varying combinations of cotton or polyester or nylon and spandex. This elastomeric material may contain from 5% to 35% spandex, and the remainder is nylon or cotton or polyester or any combinations thereof.

Preferably, covering fabric layer 88 is a three bar knit, with a ratio of about 77% nylon to about 23% spandex.

The combined stretchability of side panel 30 (or panel 30') and floating second portion 84 creates greater freedom of movement for the wearer.

Underwire 90 is made of any material that provides support. For example, underwire 90 can be made of rigid plastic or metal. In addition, the gauge of underwire 90 preferably does not vary from one end to the other.

Preferably, underwire 90 is asymmetrically shaped as shown clearly in FIGS. 2 and 3. Underwire 90 has a first or inner portion 92 that is positioned in first portion 82 of sheath, or wire channeling, 80 and follows a first angle a. Underwire 90 also has a second or outer portion 94 that is positioned in second portion 84 of sheath or wire channeling 80 and follows a second angle θ. Preferably, first angle a is greater than second angle θ. Thus, first portion 92 has a greater curve compared to second portion 94. When shaped accordingly, underwire 90 mirrors the shape of a woman's breast. Therefore, underwire 90 provides better support and enhanced comfort to the wearer.

It is preferable that first angle α equals about 55° to about 70° and, more preferably, about 63°. In comparison, it is preferable that second angle θ equals about 50° to about 65° and, more preferably, about 57°. The difference between first angle a and second angle θ is preferably about 1 to about 10 degrees and, more preferably, about 5 degrees.

The present invention having been described with particular reference to the preferred forms thereof, it will be obvious that various changes and modifications may be made without departing from the spirit and scope of the invention as defined in the appended claims.

Wherefore we claim:

1. A brassiere comprising:

a body having a pair of breast cups;

a pair of side panels, each of said pair of side panels being adjacent to a separate one of said pair of breast cups and connected to a back of said brassiere;

a pair of stretchable sheaths, each of said pair of sheaths having a first portion secured along a lower portion of said breast cup and having a second portion, said second portion being detached from said side panels such that said second portion floats along each of said side panels, each of said pair of side panels being made of a stretchable material; and a pair of underwires, each of said pair of underwires being adapted to be positioned in a separate one of said pair of sheaths.

2. The brassiere of claim 1, wherein each of said pair of side panels includes a first edge adjacent to a separate one of said pair of breast cups, and a second edge to connect each of said pair of side panels to said back of said brassiere, and a third edge adjacent an underarm of a wearer.

3. The brassiere of claim 2, wherein said second portion of each of said pair of sheaths is attached at one end to said third edge of a different one of said pair of side panels.

4. The brassiere of claim 1, wherein each of said pair of side panels is adapted to stretch primarily in a horizontal direction.

5. The brassiere of claim 1, wherein each of said pair of side panels is adapted to stretch only in a horizontal direction.

6. The brassiere of claim 1, wherein each of said pair of side panels is integrally connected to said back of said brassiere.

7. The brassiere of claim 1, wherein each of said pair of side panels is formed of an elastomeric material.

8. The brassiere of claim 7, wherein said elastomeric material is a three bar knit.

9. The brassiere of claim 8, wherein said three bar knit is made of a combination of spandex and a material selected from the group consisting of nylon, cotton or polyester.

10. The brassiere of claim 9, wherein said spandex is present in an amount of about 5% to about 35% of said three bar knit.

11. The brassiere of claim 1, wherein said second portion of each of said pair of sheaths has a distal end that is secured at said third edge.

12. The brassiere of claim 1, wherein each of said pair of sheaths is made of two plies.

13. The brassiere of claim 12, wherein the two plies include an inner ply made of one hundred percent polyester non-woven material and an outer ply made of elastomeric material.

14. The brassiere of claim 13, wherein said elastomeric material is a three bar knit made of about 77% nylon and about 23% spandex.

15. The brassiere of claim 1, wherein each of said pair of underwires has a first curve portion with a first angle and a second curve portion with a second angle.

16. The brassiere of claim 15, wherein each of said pair of underwires curves asymmetrically in a manner approximating the shape of a woman's breast.

17. The brassiere of claim 15, wherein said second angle is less than said first angle.

18. The brassiere of claim 15, wherein said first angle is about 55° to about 70°.

19. The brassiere of claim 15, wherein said second angle is about 50° to about 65°.

20. The brassiere of claim 15, wherein the difference between said first angle and said second angle is about 1 to about 10 degrees.

21. A brassiere comprising:

a body having a pair of breast cups;

a pair of side panels, each of said pair of side panels being adjacent to a separate one of said pair of breast cups and connected to a back of said brassiere;

a pair of stretchable sheaths, each of said pair of sheaths having a first portion secured along a lower portion of the breast cup and having a second portion, said second portion being detached from said side panels such that said second portion floats along each of said side panels of said brassiere, each of said pair of sheaths is made of two plies, wherein the two plies include an inner ply made of one hundred percent polyester non-woven material and an outer ply made of elastomeric material, each of said pair of side panels being made of a stretchable material, wherein said stretchable material is a three bar knit made of a combination of a material selected from the group consisting of nylon, cotton or polyester, and spandex; and a pair of underwires, each of said pair of underwires being positioned in a separate one of said pair of sheaths.

22. The brassiere of claim 21, wherein each of said pair of underwires curves asymmetrically in a manner approximating the shape of a woman's breast.

23. The brassiere of claim 22, wherein each of said pair of underwires has a first curve portion with a first angle and a second curve portion with a second angle, wherein said second angle is less than said first angle.

24. The brassiere of claim 23, wherein said first angle is about 55° to about 70°, and wherein said second angle is about 50° to about 65°.

* * * * *